United States Patent [19]

Cinotti

[11] Patent Number: 4,745,727

[45] Date of Patent: May 24, 1988

[54] DEVICE SERVING TO FASHION CARRYING HANDLES FOR ATTACHMENT TO SHEET WRAPPING MATERIAL, AND A HANDLE OBTAINED WITH SUCH A DEVICE

[75] Inventor: Andrea Cinotti, Bologna, Italy

[73] Assignee: Wrapmatic, S.p.A., Bologna, Italy

[21] Appl. No.: 42,935

[22] Filed: Apr. 27, 1987

[30] Foreign Application Priority Data

May 2, 1986 [IT] Italy ..... 3407 A/86

[51] Int. Cl.[4] ..... B65B 61/14

[52] U.S. Cl. ..... 53/134; 493/226; 493/357; 493/926

[58] Field of Search ..... 53/134, 413; 493/88, 493/226, 926, 909, 357, 356, 345

[56] References Cited

U.S. PATENT DOCUMENTS 3,439,591 4/1969 Class ..... 493/226 X
3,507,194 4/1970 Schwarzkopf ..... 493/226 X
3,613,523 10/1971 Wesselmann ..... 493/226 X
3,713,940 1/1973 Haugh, Jr. et al. ..... 493/226 X
3,818,810 6/1974 Bosse ..... 493/226 X

*Primary Examiner*—James F. Coan
*Attorney, Agent, or Firm*—Laff, Whitesel, Conte & Saret

[57] ABSTRACT

In a device according to the invention, a roll of narrow strip is unwound, fed through a cutting station and severed into discrete lengths which are conveyed forward above the level of the running sheet of wrapping film and at right angles to the direction in which it is run through the machine. The two ends of each discrete strip are picked up by suckers fitted to the projecting ends of a pair of arms which are drawn together through 90°, rotating about respective vertical axes, and thus cause the strip to assume a 'U' shape before being attached to the wrapping film in such a way as to furnish a carrying handle.

13 Claims, 2 Drawing Sheets

FIG 2
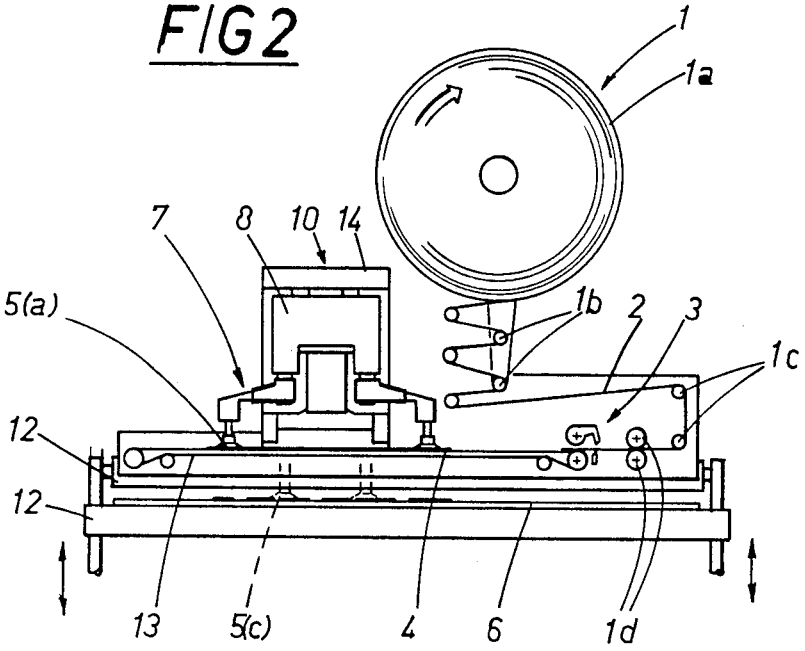
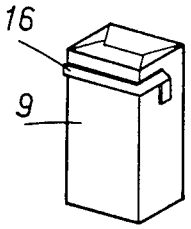
FIG 3
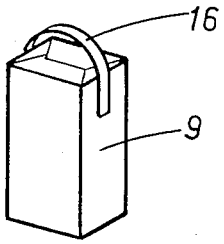
FIG 4
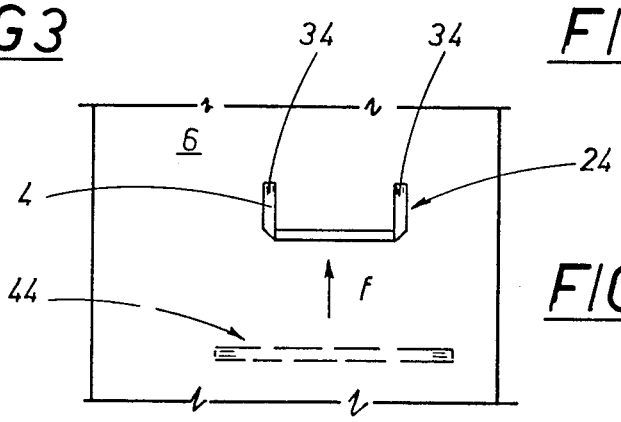
FIG 5

DEVICE SERVING TO FASHION CARRYING HANDLES FOR ATTACHMENT TO SHEET WRAPPING MATERIAL, AND A HANDLE OBTAINED WITH SUCH A DEVICE

BACKGROUND OF THE INVENTION

The invention relates to a device serving to fashion carrying handles for attachment to a sheet of wrapping film, and to a handle obtained with such a device.

The prior art embraces numerous machines that are able to produce a wrapping, with handles, such as will envelop a product to be packaged. Certain of these machines fashion the handles in the finished package, for example, by double-folding and punching hand holes through the wrapping material; however, a considerable waste of material is involved with such methods, packages of a certain length are not always easy to carry, and most significant, the machine can not readily be adapted to turn out different sizes of wrapping.

Prior art methods of fashioning the handles for such wrappings currently follow one of two distinct directions, the difference between which consists substantially in the moment at which the handle is attached to the wrapping film. In a first method, the handle is applied to a wrapping which already envelops the packaged product, whereas in a second method, developed by the same applicant, a piece of material constituting the handle is applied to the film before the product is wrapped.

Departing from this second method, which is able to avoid damage to the product occasioned by application of the handle and permits of adapting the machine for different sizes of wrapping in extremely simple fashion, the applicant now seeks to overcome a drawback relating to the thickness of the wrapping materials utilized, namely, the bulk sheet, or film, and the strip material used to fashion the handle.

A tendency exists, dictated by cost, to limit the thickness both of the film and of the handle strip as far as possible, with the result that the finished wrapping does not always afford sufficient strength when the package is suspended and carried by its handle.

Practical experiment has shown that the film tends to break, not at the point where the handle is joined (heat-sealed in the majority of instances), but in the area immediately surrounding the join.

Accordingly, the object of the invention is to overcome this drawback and thus permit of utilizing film of limited thickness in the interests of costeffective manufacture.

SUMMARY OF THE INVENTION

The stated object is achieved by adoption of a device as disclosed and claimed herein.

A device according to the invention is able to pick up discrete lengths of the carrying strip one by one and fold the two ends, then to attach the strip to the wrapping film at points which coincide with the median axes of two opposite sides of the finished package.

The invention provides significant advantages; in particular, the heat-sealed points of attachment between strip and film are effected in such a way that when the wrapped product is suspended by its handle, the resultant mechanical stresses will tend to induce shear strain only, signifying increased strength of the package as a whole.

BRIEF DESCRIPTION OF THE DRAWINGS

The invention will now be described in detail, by way of example, with the aid of the accompanying drawings, in which:

FIG. 2 is a front elevation of the device in FIG. 1;

FIG. 3 is the perspective of a wrapping furnished with the handle according to the invention, showing the position of the handle on the formed package;

FIG. 4 is the perspective of the wrapping in FIG. 3, seen with the handle in the carrying position;

FIG. 5 is a plan illustrating the positioning of the handle on the wrapping film.

DESCRIPTION OF THE PREFERRED EMBODIMENT

Figure 1:
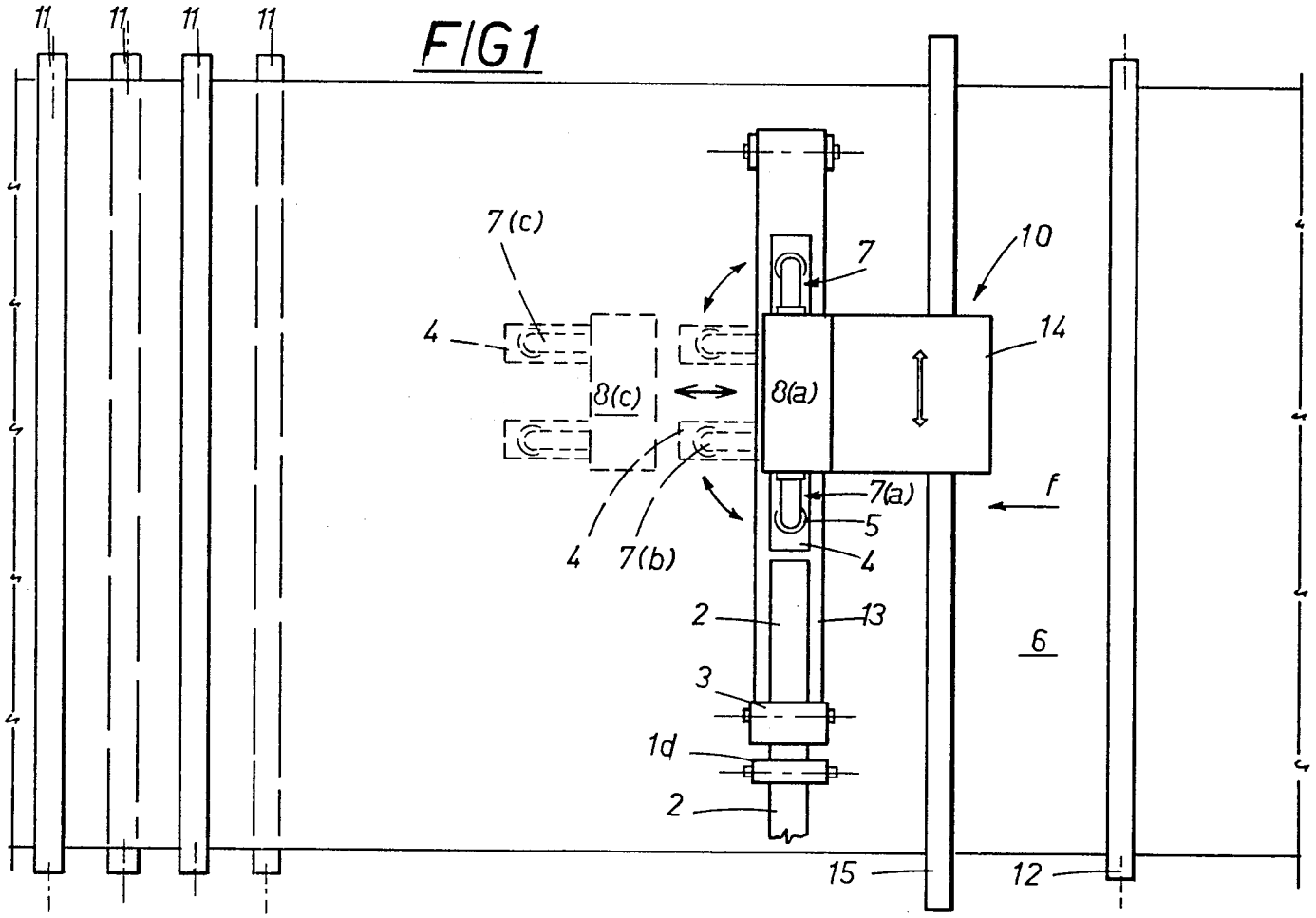
FIG. 1 is a schematic representation of the device according to the invention, viewed in plan and with certain parts omitted better to reveal others, which also shows components of the machine into which the device itself is integrated.

In FIG. 1 of the drawings, 10 denotes a device by which carrying handles are fashioned in readiness for attachment to a sheet of wrapping film 6 that will ultimately envelop a product. The device 10 is integrated into a conventional wrapping machine of which the essential parts only are illustrated, in the interests of clarity, namely, a set of freely revolving parallel rollers 11, and two bars 12 lying parallel with the rollers and in vertical alignment one with the other. The freely revolving rollers 11 are set apart at a given distance one from the next, and journalled to flexible supports (conventional, and therefore not illustrated), in such a way as to enable their drawing together as the film 6, which follows a zig-zag course through the rollers, is subjected to greater tension. Rollers thus arranged therefore function as dancers, as a person skilled in the art will be aware. The two parallel bars 12 are located one above and one below the film 6, and can be drawn together to the point of gripping the film and halting its progress. The bars are located upstream of the rollers 11 in such a way that, when gripping and restraining the film 6, the rollers 11 will draw together and thus enable continuous feed to the downstream stations of the machine for the duration of bars' operating cycle.

The device 10 comprises infeed means 1 the purpose of which is to supply bulk strip 2, of width considerably less than that of the wrapping film 6, and cutting means 3 that sever the bulk strip into discrete strips 4 of a given length.

The infeed means 1 will be seen, in FIG. 2, to comprise a roll 1*a* of bulk strip 2, a set of dancing rollers 1*b*, a set of intermediate rollers 1*c* and a pair of pinch rollers 1*d* by which the strip is fed into the cutting means 3. The pinch rollers 1*d* will be driven intermittently for a duration commensurate with the length of the discrete strip 4, operating synchronously with the systems that feed and handle the wrapping film 6.

According to the invention, the device 10 is provided with means 13 for supporting and feeding the discrete strips 4, located downstream of the cutting means, and means 5 for retaining the strips carried by the support and feed means 13.

The support and feed means 13, which might be embodied as a conveyor belt, are located above the film 6, disposed at right angles to the direction in which it is fed, denoted f in FIG. 1.

The retention means 5 might be embodied as a pair of suckers, and indeed are described as such in the specification for the sake of simplicity, though other options exist such as mechanical grips etc.; at all events, such retention means 5 are carried by the projecting ends of a pair of hinged arms 7 the remaining ends of which are pivotably attached to a slide 8 disposed at right angles to the belt 13.

The arms 7 are rotatable about two vertical axes between a first limit position, in which they are aligned and parallel with the belt 13 (see bold outline in FIG. 1, denoted *7a*), and a second limit position in which they are disposed substantially at right angles to the belt 13 with the suckers 5 drawn as close together as is permitted (see broken line in FIG. 1, denoted *7b* and *7c*).

The two suckers 5 are capable of vertical movement between a raised position, in which they lie marginally above the level of the belt 13 (see bold outline in FIG. 2, denoted *5a*) and a lowered position in which they hold the discrete strip 4 in contact with the wrapping film 6 (see broken line in FIG. 2, denoted *5c*).

In the embodiment shown in the drawings, which is illustrated by way of example, vertical movement of the suckers 5 is obtained by enabling movement of the arms 7 along their respective axes of rotation; for faster positioning of the suckers 5, linear and rotary movement of the arms 7 along and about their axes of rotation would be effected simultaneously.

The distance separating the axes of rotation of the arms 7 (which may be variable) and therefore the minimum distance that separates the suckers 5 following rotation of the arms into the second limit position *7b*, must correspond to the developable distance between the median axes of two opposite sides of the wrapping 9 (FIGS. 3 and 4). Accordingly, the arms 7 will be adjustable for length, embodied telescopically for example, as in FIGS. 1 and 2, to permit of adapting to the length of the discrete strip 4.

The slide 8 is capable of axial movement, and carried by a movable structure 14 that traverses along at least one rail 15 spanning the width of the film 6, thereby enabling transverse positioning of the slide 8, hence of the suckers 5, in relation to the film. The slide 8 can be moved between two limit positions: retracted (*8a* in FIG. 1), in which the axes of rotation of the two arms 7 are vertically aligned with the belt 13; and extended (*8c*), with the axes of rotation lying outside the area occupied by the belt 13.

The device thus embodied will also comprise means, such as a source of pneumatic suction (not illustrated), which connects with the suckers 5 and operates them synchronously with the movements of the wrapping machine as a whole.

Operation of the device according to the invention will now be described, departing from the configuration illustrated by the bold outline of FIGS. 1 and 2, in which the arms 7 are aligned (*7a* in FIG. 1), the suckers raised (*5a*, FIG. 2), the slide 8 in retracted position (*8a*, FIG. 1), and the bars 12 separated one from the other.

During the time taken for the arms 7 and the slide 8 to reach the 'a' configuration, the pinch rollers 1*d* will have fed in a length of strip 2 from which the cutting means 3 in their turn will have severed a discrete length to be conveyed forward by the belt 13 to a point beneath the suckers 5. The suckers 5 now connect with suction, and duly pick up the two ends of the discrete strip 4, whereupon the arms 7 are rotated into the position denoted *7b*, in which they lie parallel. This movement of the arms 7 causes the suckers 5 to twist the two ends of the strip 4, which is obliged to pass around the axes of rotation of the arms 7 themselves. Accordingly, the discrete strip 4 assumes a 'U' shape (denoted 24 in FIG. 5), its two ends parallel with the direction of movement f of the wrapping film 6.

The slide 8 is now moved into its extended position (*8c* in FIG. 1) and the suckers 5 are lowered until the discrete strip 4 is brought into contact with the film 6 (position *5c* in FIG. 2). The machine will incorporate conventional heat-sealing means (not illustrated) installed below the level of the film 6, against which the ends 34 of the U-shaped strip 4 and the film 6 are pressed by the descending suckers 5 to produce a join. Before the two ends 34 actually make contact with the film 6, the bars 12 will come together and grip the film, preventing it from moving forward; the dancers 11 are drawn closer together in response to increased tension on the film, which continues to be carried forward in spite of the momentary restraint. With the heat-sealing operation accomplished, the arms 7 and the slide 8 are returned to the at-rest positions denoted *7a* and *8a* in FIGS. 1 and 2.

The wrapping film 6 thus exits from the device with discrete U-shaped strips 4 attached at regular intervals.

The packaged end product is enveloped by a wrapping 9 as in FIG. 3, with a handle 16 attached to two opposite sides; the handle will be seen to hug these two sides, plus a third side in between the two; thus, with the packaged products stacked for transportation and warehousing purposes, the handle 16 remains totally in contact with the wrapping 9. Before the package is carried, the handle 16 will be untwisted and freed from the contour of the wrapping by being rotated about its longitudinal axis into the position show in FIG. 4. It will be observed that the parts of the handle and the wrapping material heat-sealed together are positioned such that the stresses on them are substantially shear stresses, thereby ensuring increased strength of the wrapping as a whole when suspended and carried.

The device illustrated in the drawings is by no means definitive. The option exists, for example, of producing vertical movement of the suckers 5 by embodying the movable structure 14 such as to raise and lower the slide 8, or embodying the suckers 5 in such a way as to move in relation to the arms 7. Similarly, the arms 7 might be fitted to the slide 8 in such a way that the distance separating their axes of rotation can be adjusted according to the dimensions of the wrapping. Again, the arms 7 need not necessarily rotate about their vertical axes, but could be made to attach a conventional handle 44 as shown in FIG. 5; even in this instance, however, the heat-sealed joins will remain subject to shear stresses only, being located at opposite sides of the finished wrapping. The option also exists of enabling traverse of the slide rail 15 parallel to the feed direction f of the wrapping film 6, at the same speed, in order to render the positioning and heat-sealing operation fully continuous.

What is claimed:

1. A device serving to fashion carrying handles for attachment to sheet wrapping material, comprising:

infeed means supplying narrow bulk strip from which single handles are formed;

cutting means with which to sever the bulk strip into discrete strips of given length;

support and feed means, located downstream of the infeed and cutting means, that convey the discrete strip through a rectilinear path above the level of the wrapping film;

means for retention of the two opposite ends of a discrete strip conveyed by the support and feed means, that are capable of vertical movement between a raised limit position in which the discrete strip is picked up from the support and feed means and a lowered limit position in which the discrete strip is offered to the film, and carried by first ends of a pair of identical arms mounted to a slide by their remaining ends and capable of horizontal movement between a first limit position, in which they are in alignment and parallel with the support and feed means, and a second limit position in which they lie substantially at right angles to the support and feed means with the strip retention means occupying points on the wrapping film that are calculated to coincide with the median axes of two opposite sides of the finished wrapping.

2. Device as in claim 1, wherein the arms are pivotably mounted to the slide in such a way as to rotate about respective vertical axes.

3. Device as in claim 1, wherein the arms that carry the retention means are adjustable, and can be lengthened or shortened to match the length of the discrete strip.

4. Device as in claim 1, wherein the retention means are capable of vertical movement in relation to the respective arms by which they are carried.

5. Device as in claim 1, wherein the arms which carry the retention means are capable of movement along their respective axes of rotation in order to permit of moving the retention means between their raised and lowered limit positions.

6. Device as in claim 5, wherein the arms which carry the strip retention means are capable of simultaneous linear and rotary movement along and about their respective axes of rotation.

7. Device as in claim 5, wherein the arms which carry the retention means are mounted to the slide in such a way as to allow adjustment of the distance separating their respective axes of rotation.

8. Device as in claim 1, wherein the slide to which the arms carrying the retention means are mounted is capable of movement on a level above the support and feed means and in a direction at right angles thereto, and of movement parallel with the support and feed means along at least one traverse rail.

9. Device as in claim 8, wherein the support and feed means are disposed at right angles to the feed direction of the wrapping film.

10. Device as in claim 1, wherein the means for retention of a discrete strip operate by suction.

11. Device as in claim 1, wherein the means for retention of a discrete strip are mechanical, and employ miniaturized grips.

12. Device as in claim 9, wherein the traverse rail is capable of reciprocating parallel with the feed direction of the wrapping film and at identical speed thereto, at least during attachment of the discrete strip to the film.

13. Device as in claim 9, comprising an immovable traverse rail positioned above the wrapping film and operating in conjunction with means located upstream and downstream of the device in relation to the feed direction of the film, the functions of which are to grip the film and to compensate for changes in feed conditions, respectively.

* * * * *